United States Patent [19]

Ichimura et al.

[11] Patent Number: 4,933,251

[45] Date of Patent: Jun. 12, 1990

[54] ELECTROPHOTOGRAPHIC DEVELOPER

[75] Inventors: Masanori Ichimura; Toru Murakami; Koichi Oyamada, all of Kanagawa, Japan

[73] Assignee: Fuji Xerox Co., Ltd., Tokyo, Japan

[21] Appl. No.: 228,199

[22] Filed: Aug. 4, 1988

[30] Foreign Application Priority Data

Aug. 10, 1987 [JP] Japan ..... 62-198298

[51] Int. Cl.[5] ..... G03G 9/10

[52] U.S. Cl. ..... 430/109; 430/111

[58] Field of Search ..... 430/109, 110, 106.6, 430/111

[56] References Cited

U.S. PATENT DOCUMENTS 4,513,074 4/1985 Nash et al. ..... 430/109

4,623,604 11/1986 Takagiwa et al. ..... 430/109

*Primary Examiner*—John L. Goodrow

*Attorney, Agent, or Firm*—Finnegan, Henderson, Farabow, Garrett and Dunner

[57] ABSTRACT

An electrophotographic developer is described, comprising toner particles and carrier particles, characterized in that the toner particles have a layer of externally additive agents comprising fine metal oxide particles having an electric resistance of $1\times10^2$ to $1\times10^9$ Ω·cm and fine silica particles and cleaning aid particles, and the layer of externally additive agents does not have a chain like structure.

7 Claims, 1 Drawing Sheet

ELECTROPHOTOGRAPHIC DEVELOPER

FIELD OF THE INVENTION

The present invention relates to an electrophotographic developer for developing electric latent images and more particularly to a developer for use in electrophotography, which has improved electric charge exchanging properties and a greatly decreased tendency for the toner to become attached to non-image areas of electrophotographic light-sensitive material.

BACKGROUND OF THE INVENTION

Various electrophotographic processes are known as described in, for example, U.S. Pat. No. 2,297,691, JP-B-42-23910 and JP-B-24748 (the term "JP-B" as used herein means an "examined Japanese patent publication"). In general, an electric latent image is formed by various techniques using a photoconductive substance on a light-sensitive material, the latent image is developed with a toner, and then the resulting powder image is transferred to a substrate, such as paper, and fixed by heating or with solvent vapor, if desired, to obtain desired copies.

Known methods for visualizing an electric latent image with a toner include, for example, the magnetic brush method described in U.S. Pat. No. 2,874,063, the cascade developing method described in U.S. Pat. No. 2,618,552, and the powder cloud developing method described in U.S. Pat. No. 2,221,776.

A mixture of particles of a toner and a carrier is usually used as an electrophotographic developer. Typically, the toner is obtained by melt kneading a resin such as polystyrene, a styrene-butadiene copolymer or polyester, and a pigment or dye, such as carbon black or phtholocyanine blue, as colorant and then grinding the resulting kneaded product to 1 to 30 μm. The carrier is a particle having an average particle diameter nearly equal to the particle diameter of the toner or up to 500 μm formed of glass bead, iron, nickel or ferrite, or such a particle coated with various resins.

However, with a developer consisting of the above ingredients, the desired charging level (i.e. charging amount), charging speed, electric charge exchanging properties, uniformity of charging, dependency on circumstances of image quality, and durability of developer cannot be obtained. Thus, a charging controller additive has been added in an attempt to improve the developer.

The aforementioned requirements are not always satisfied, however, merely by adding a conventionally used charging controller. Particularly in a system in which a metal oxide powder having a electric resistance of $1\times10^2$ to $1\times10^9\Omega\cdot$cm is added as a charging controller, the desired charging level and electric charge exchanging properties do not correspond to the amount of the charging controller added. If the charging level is controlled to the desired level, the electric charge exchanging properties are markedly reduced, and attachment of the toner to non-image areas of a light-sensitive material is increased, and only copies having increased fog are obtained.

SUMMARY OF THE INVENTION

Therefore, the primary object of the present invention is to provide an electrophotographic developer satisfying the properties required in the above mentioned electrophotographic techniques.

More specific objects of the present invention are to provide an electrophotographic developer in which the desired charging level can be attained, which has excellent electric charge exchanging properties, provides a sharp electric charge distribution and has a greatly decreased tendency for the toner to become attached to non-image areas of a light-sensitive material even after toner admixing (that is, after addition of a fresh toner). Other objects of the invention are to provide such an electrophotographic developer which causes less contamination of the machine, has excellent durability, and produces a stabilized image quality when copying a large number of sheets.

The present invention relates to an electrophotographic developer comprising toner particles and carrier particles, wherein the toner particles have a layer of externally additive agents comprising fine metal oxide particles having an electric resistance of $1\times10^2$ to $1\times10^9\Omega\cdot$cm and fine silica particles. Preferably, the layer of externally additive agents comprises the above metal oxide particles, the fine silica particles and particles of a cleaning aid. When the toner particles, metal oxide particles and silica particles are mixed in a Henschel mixer at a circumferential speed of least 30 m/sec., the layer of externally additive agents does not have a chain like structure.

DETAILED DESCRIPTION OF THE INVENTION

The electrophotographic developer of the present invention will hereinafter be explained with reference to the attached drawings.

Figure 1:
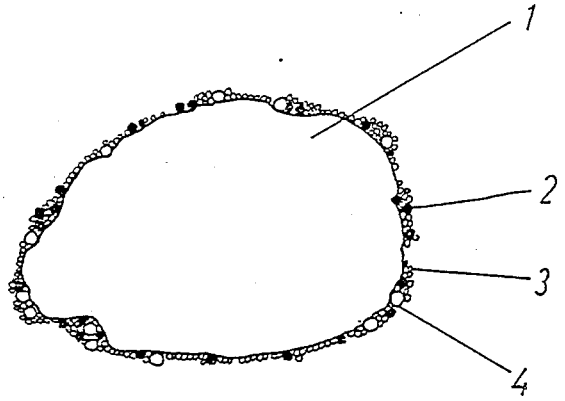
FIG. 1 is a schematic cross-sectional view of a toner particle of the electrophotographic developer of the present invention.
Figure 2:
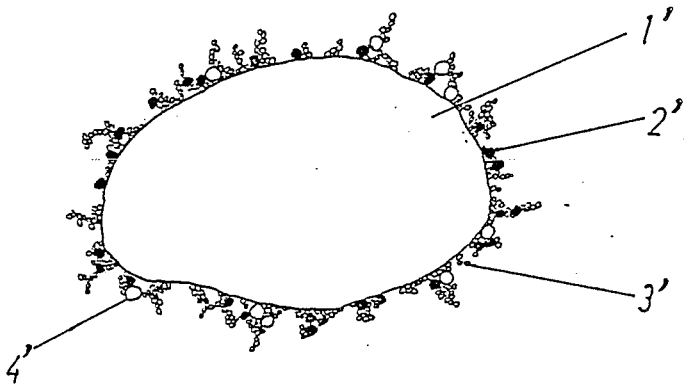
FIG. 2 is a schematic cross-sectional view of a conventional toner particle.

FIG. 1 is a schematic cross-sectional view of a toner particle of the electrophotographic developer of the present invention, and FIG. 2 is a schematic cross-sectional view of the conventional toner particle. In FIG. 1 the reference numeral 1 indicates a toner particle; the numeral 2, a metal oxide particle; the numeral 3, a fine silica particle; and the numeral 4, a cleaning aid.

In the conventionally used toner particle, as shown in FIG. 2, particles of externally additive agents such as metal oxide particles 2', fine silica particles 3', and cleaning aid particles 4' tend to adhere to one another in clumps with a slight adhesion force, and these clumps adhere to the toner particles 1' in such a manner that the surface of the toner is not evenly covered since the particles of externally additive agents weakly adhere to the toner particle in the form of the chain like structure (that is, structure in that the particles of externally additive agents adhere each other like a bunch of grapes). As shown, the clumps of particles of externally additive agents are grouped together, covering only some areas of the surface, while other areas of the surface of the toner particles are bare.

On the other hand, in the toner particle of the electrophotographic developer of the present invention, as shown in FIG. 1, the layer of externally additive agents formed on the surface of the toner particle does not have the chain like structure. The particles of externally additive agents relatively strongly adhere to the toner and to one another, and adhere to the toner in such a manner that they cover the whole or part of the toner.

The electric resistance of the fine metal oxide particle of the present invention is $1\times10^2$ to $1\times10^9\Omega\cdot$cm and is preferably $1\times10^5$ to $1\times10^8\Omega\cdot$cm. If the electric resistance is less than $1\times10^2\Omega\cdot$cm, the electric resistance of the developer is decreased, and the frictional charging effect is reduced, leading to a decrease in transferring properties, or a decrease in image density and an increase in fog. On the other hand, if the electric resistance is more than $1\times10^9\Omega\cdot$cm, the edge effect is readily caused, and the frictional charging amount is excessively increased, leading to a decrease in image density and a decrease in transferring properties.

Metal oxides which can be used in the present invention include tin oxide, zinc oxide, aluminum oxide, titanium oxide, zirconium oxide and the like. Among these, tin oxide and aluminum oxide are preferred.

The average particle diameter of the fine metal oxide particles is preferably not more than 0.3 μm. The amount of the fine metal oxide particles added is preferably 0.1 to 5.0 parts by weight, more preferably 1.0 to 3.0 parts by weight, per 100 parts by weight of the toner.

The electric resistance of the fine metal oxide particle was measured by the use of simplified specific resistance measuring apparatus using a teflon cell with a diameter of 5.5 cm and a press ram with a diameter of 4.2 cm and an area of 13.85 $cm^2$ while applying an oil pressure of 35.5 $kg/cm^2$ onto a hand press (that is, applying a pressure of 100 $kg/cm^2$ onto a sample). The diameter of the fine metal oxide particle was measured by the sedimentation method and the centrifugal sedimentation method.

As the fine silica particles, there can be used in the present invention, fine silica particles themselves, or silicon dioxide particles having a surface silicon atom in which silicon atoms having 1 to 3 organic groups bonded directly to silicon by a silicon-carbon bonding is chemically bonded through a silicon oxygen-silicon bonding, as described in JP-B-54-16219. The fine silica particles may be subjected to hydrophobic surface treatment.

As the cleaning aid, polyvinylidene fluoride powder, and polymethyl methacrylate powder can be used. The average particle diameter of the cleaning aid is preferably from 0.05 to 5 μm.

The amount of the cleaning aid added is preferably from 0.01 to 10 parts by weight, and more preferably from 0.05 to 5 parts by weight, per 100 parts by weight of the toner.

Known toner particles can be used as the toner in the present invention. Examples of binder resins which can be used in the toner particle include homopolymers or copolymers of styrenes such as styrene, chlorostyrene and vinylstyrene; monoolefins such as ethylene, propylene, butylene, and isobutylene; vinyl esters such as vinyl propionate, vinyl benzoate and vinyl acetate; α-methylene aliphatic monocarboxylic esters such as methyl acrylate, ethyl acrylate, butyl acrylate, dodecyl acrylate, octyl acrylate, phenyl acrylate, methyl methacrylate, ethyl mechacrylate, butyl methacrylate, and dodecyl methacrylate; vinyl ethers such as vinyl methyl ether, vinyl ethyl ether, and vinyl butyl ethers; vinyl ketones such as vinyl methyl ketone, vinyl hexyl ketone, vinyl isopropenyl ketone, and the ike. Particularly preferable binder resins are polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, and polypropylene. In addition, polyester, polyurethane, an epoxy resin, a silicone resin, polyamide, modified resin, paraffin, and waxes can be used.

Typical examples of the colorant for the toner include carbon black, Nigrosine dye, aniline blue, charcoyl blue, chromium yellow, ultramarine blue, dupont oil red, quinoline yellow, methylene blue chloride, phthalocyanine blue, malachite green oxalate, lamp black, rose bengale, C.I. pigment red 48:1, C.I. pigment red 122, C.I. pigment red 57:1, C.I. pigment yellow 97, C.I. pigment yellow 12, C.I. pigment blue 15:1, and C.I. pigment blue 15:3.

The binder resin and the colorant of the present invention are not limited to those described above and any suitable resin or colorant may be used.

In the present invention, toner particles having an average particle diameter of generally less than about 30 μm, preferably from 3 to 30 μm can be used.

The electrophotographic developer of the present invention can be used as a so-called two-component developer system employing a carrier and a toner.

The carrier particles generally have an average particle diameter of up to 500 μm, preferably from 10 to 200 μm, and more preferably from 30 to 100 μm. Various known particles such as iron, nickel, cobalt, iron oxide, ferrite, glass bead, granular silicone or similar particles can be used. Such carrier particles are disclosed in U.S. Pat. Nos. 2,618,441, 2,638,522, 3,533,835, 3,847,604 and 3,767,598. The surface of the carrier particle may be coated with a coating agent, such as a fluorine-based resin, an acrylic resin, or a silicone resin.

The electrophotographic developer of the present invention can be prepared by first mixing the aforementioned metal oxide particles, fine silica particles, cleaning aid and toner particles to form a layer of externally additive agents on the toner particles. Then, these are mixed with carrier particles.

As a mixing machine for the above mixing process, a mixer such as a Henschel mixer, the adhesion force of which can be readily changed by changing speed of revolution thereof, is preferably used. The mixing of the toner particles with the particles of externally additive agents is preferably carried out at a circumferential speed of at least 30 m/sec. At this speed, the particles of externally additive agents adhere to the surface of toner particles without producing a chain like structure, and thus there is formed a layer of externally additive agents not having the chain like structure.

The electrophotographic developer of the present invention can be used for developing an electrostatic latent image formed on an electrophotographic photoreceptor or an electrostatic recording material. That is, an electrostatic latent image is electrophotographically formed on (1) a light-sensitive material made of an inorganic photoconductive material such as selenium, zinc oxide, cadmium oxide or amorphous silicon, or (2) an organic photoconductive material such a phthalocyanine dye or bisazo dye. Alternatively, an electrostatic latent image is formed on an electrostatic recording material having a dielectric material (such as polyethylene terephthalate), by the use of a needle-like electrode, and the developer of the present invention attaches to the above electrostatic latent image to form a toner image. This toner image is transferred to a transferring material such as paper and fixed to form a copy, and the remaining toner is cleaned from the surface of the light-sensitive material. For this cleaning, the blade method, the brush method, the web method, the roll method or the like can be employed.

The present invention is characterized in that the toner particles have a layer of externally additive agents comprising fine metal oxide particles having an electric resistance of $1\times10^2$ to $1\times10^9\Omega\cdot$cm and fine silica particles, or such fine metal oxide particles, fine silica particles and cleaning aid particles, and the layer of externally additive agents does not have a chain like structure. This structure, in accordance with the present invention, produces excellent effects in that electric charge exchanging properties between toners are increased, the electric charge distribution is sharp even after addition of toners, (toner admixing), and in that both the attachment of toners to non-image areas of a light-sensitive material and the contamination of the inside of an electrophotographic copying machine are decreased. The electrophotographic developer of the present invention is excellent in durability and in copying a large number of sheets an image of stabilized quality can be obtained.

The present invention is described in greater detail with reference to preferred embodiments thereof as described in the following examples.

EXAMPLE 1

A graft polymer of a propylene polymer, a styrene-n-butyl methacrylate copolymer (54 parts by weight), a styrene-n-butyl methacrylate cross-linked polymer (36 parts by weight) and a C.I. pigment red 48:1 (Symuler Neothol Red 2BY produced by Dai Nippon Ink Kagaku Kogyo Co., Ltd.) (10 parts by weight) were melt kneaded, finely divided and sieved to obtain red toner particles having an average particle diameter of 12 μm. To 100 parts by weight of the above particles, 2.0 parts by weight of fine powder of titanium oxide having an electric resistance of $8\times10^8\Omega\cdot$cm, 1.5 parts by weight of fine powder of silica, and 0.7 part by weight of powder of polymethylmethacrylate were added. These were mixed for 30 minutes in a Henschel mixer at a circumferential speed of 33 m/s and then subjected to heat treatment in a flow vessel at 95° C. for 1 minute to obtain a red toner. An electron microscopic examination confirmed that a chain like structure was not formed in the layer of externally additive agents formed on the surface of the toner particles.

EXAMPLE 2

A terminal dimethylesterified polyester (34 parts by weight), polypropylene wax (1 part by weight), a styrene-n-butyl methacrylate copolymer (55 parts by weight), a C.I. pigment red 48:1 (Sumika print Red KF produced by Sumitomo Kagaku Kogyo Co., Ltd.) (5 parts by weight) and a C.I. pigment red 48:1 (Symuler Neothol Red 2BY produced by Dai Nipopn Ink Kagaku Kogyo Co., Ltd.) were kneaded, finely divided and sieved to obtain red toner particles having an average particle diameter of 11.5 μm. To 100 parts by weight of the above toner particles, 1.5 parts by weight of fine tin oxide particles having an electric resistance of $5\times10^7\Omega\cdot$cm, 0.9 part by weight of hydrophobic fine silica powder and 0.4 part by weight of polyvinylidene fluoride powder were added. These were mixed for 60 minutes in a Henschel mixer at a circumferential speed of 50 m/s to obtain red toner particles. An electron microscopic examination confirmed that in the layer of externally additive agent formed on the surface of the toner particles, a chain like structure was not formed.

EXAMPLE 3

A styrene-n-butyl methacrylate copolymer (90 parts by weight), copper tetra (alkylsufonamido) phthalocyanine (9 parts by weight), and fine silica powder (1 part by weight) were kneaded, finely divided and sieved to obtain red toner particles having an average particle diameter of 13 μm. To 100 parts by weight of the above toner particles, 0.5 part by weight of fine aluminum oxide powder having an electric resistance of $3\times10^2\Omega\cdot$cm and 1.2 parts of hydrophobic silica particles were added. These were mixed for 30 minutes in a Henschel mixer at a circumferential speed of 60 m/s to obtain blue toners. An electron microscopic examination confirmed that in the layer of externally additive agents formed on the surface of the toner particles, a chain like structure was not formed.

COMPARATIVE EXAMPLE 1

Red toner particles were obtained in the same manner as in Example 1. The red toner particles and 2.0 parts by weight of fine titanium oxide particles having an electric resistance of $8\times10^8\Omega\cdot$cm, 1.5 parts by weight of fine silica particles and 0.7 part by weight of polymethyl methacrylate particles were mixed for 3 minute in a Henschel mixer at a circumferential speed of 15 m/s to obtain red toner particles. An electron microscopic examination confirmed that on the surface of the toner particle, the particles of externally additive agents attached forming a chain like structure.

COMPARATIVE EXAMPLE 2

Red toner particles were obtained in the same manner as in Example 2. The red toner particles and 1.5 parts by weight of fine tin oxide particles having an electric resistance of $5\times10^7\Omega\cdot$cm, 0.9 part by weight of hydrophobic silica particles and 0.4 part by weight of polyvinylidene fluoride particles were mixed for 5 minutes in a Henschel mixer at a circumferential speed of 15 m/s to obtain red toner particles. An electron microscopic examination confirmed that on the surface of the toner particles, the particles of externally additive agents attached forming a chain like structure.

COMPARATIVE EXAMPLE 3

Blue toner particles were obtained in the same manner as in Example 3. The blue toner particles and 0.5 part by weight of aluminum oxide particles having an electric resistance of $3\times10^2\Omega\cdot$cm and 1.2 parts by weight of hydrophic fine silica particles were mixed for 8 minutes in a Henschel mixer at a circumferential speed of 15 m/s to obtain blue toner particles. An electron microscopic examination confirmed that on the surface of the toner particles, the particles of externally additive agents attached forming a chain like structure.

TESTING METHOD AND EVALUATION

A carrier comprising a ferrite core having an average particle diameter of 130 μm and a styrene-n-butyl methacrylate copolymer covered thereon was mixed with each of the toners of Examples 1 to 3 and Comparative Examples 1 to 3 to prepare a series of developers. The amount of the toner was 3.5 parts by weight per 100 parts by weight of the carrier for each of the developers.

Then, 100 g of each developer was placed in a 250-milliliter broad open bottle, shaken by the use of a tumbler shaker for 10 minutes, and after stopping the shaking, the developer was sampled. Additionally, 3.5 g of the toner was added (toner admix) and the resulting mixture was shaken for 30 seconds and the developer was sampled. The charging amount (level) and electric charge distribution were determined for each sample, and the results are shown in the following table.

Independently, 900 g of each developer was placed in a developing unit of a copying machine with a two component magnetic brush developing machine (Fuji Xerox 3870), and a continuous copying test of 10,000 sheets was carried out. The test results are shown in the following table.

The charging amount and the electric charge distribution were determined for each sample bottle at the start and after copying 10,000 sheets, as well as the presence of fog in non-image areas and contamination in the machine.

TABLE

| | Shaking Test | | | | Continuous Copying Test | | | | | |
|---|---|---|---|---|---|---|---|---|---|---|
| | 10 min. Shaking | | Admix 30 Seconds | | Start | | After 10,000 copying | | | |
| | Charging Amount (μc/g) | Electric Charge Distribution* (mm) | Charging Amount (μc/g) | Electric Charge Distribution (mm) | Charging Amount (μc/g) | Electric Charge Distribution (mm) | Charging Amount (μc/g) | Electric Charge Distribution (mm) | Fog of Non-Image Area of Light-Sensitive Material | Contaminate |
| Example 1 | 15 | 4.0 to 10 | 13.5 | 2 to 8 | 13.8 | 4 to 8 | 13.5 | 4 to 1 | none | none |
| Comparative Example 1 | 20.2 | 3.0 to 17 | 9.6 | −5 to 6 | 15.8 | 2 to 12 | 12.1 | −3 to 12 | presence | presence |
| Example 2 | 16.2 | 5.0 to 9 | 15.0 | 4 to 8 | 14.7 | 4 to 7 | 14.0 | 4 to 8 | none | none |
| Comparative Example 2 | 21.7 | 2.5 to 15 | 9.2 | −5 to 9 | 17.2 | 2 to 10 | 13.2 | −2 to 13 | presence | presence |
| Example 3 | 18.0 | 5.0 to 11 | 16.3 | 3 to 8 | 15.1 | 3 to 9 | 15.5 | 3 to 9 | none | none |
| Comparative Example 3 | 20.6 | 1.0 to 13 | 7.5 | −6 to 11 | 16.5 | 1 to 9 | 10.1 | −4 to 15 | presence | presence |

*Measured by Charge Spectrograph (Electrophotography Association Journal, Vol 22, No. 1 (1983), p.85).

Having described preferred embodiments of the present invention, it is to be understood that variations and modifications thereof falling within the spirit and scope of the invention will become apparent to those skilled in the art and that the scope of the invention is to be limited only by the appended claims and their equivalents.

What is claimed is:

1. An electrophotographic developer comprising toner particles and carrier particles, wherein the toner particle has on the surface thereof a layer of externally added agents comprising fine metal oxide particles having an electric resistance of $1\times10^2$ to $1\times10^9\Omega$·cm and fine silica particles, and the layer of externally added agents has a non-chain like structure.

2. The electrophotographic developer as claimed in claim 1 wherein said layer of externally added agents further includes cleaning aid particles.

3. The electrophotographic developer as claimed in claim 1, wherein the layer of externally added agents is formed by adding fine metal oxide particles having an electric resistance of $1\times10^2$ to $1\times10^9\Omega$·cm and fine silica particles to the toner particles, and then mixing said metal oxide, silica and toner particles in a Henschel mixer at a circumferential speed of a least 30 m/sec.

4. The electrophotographic developer as claimed in claim 1, wherein an amount of the fine metal oxide particles added is from 0.1 to 5.0 parts by weight per 100 parts by weight of the toner.

5. The electrophotographic developer as claimed in claim 1, wherein an average particle diameter of the fine metal oxide particles is 0.3 μm or less.

6. The electrophotographic developer as claimed in claim 1, wherein said toner particles have an average particle diameter of less than about 30 μm.

7. The electrophotographic developer as claimed in claim 1, wherein said carrier particles have an average particle diameter less than 500 μm.

* * * * *